United States Patent [19]

Molitor et al.

[11] Patent Number: 4,786,262

[45] Date of Patent: Nov. 22, 1988

[54] ELECTRICAL CONTACT DEVICE

[75] Inventors: Paul-Rainer Molitor, Muhldorf/Inn; Bernhard Neumann, Waildkraiburg, both of Fed. Rep. of Germany

[73] Assignee: Otto Dunkel GmbH Fabrik Fur Elekrotechnische Gerate, Muhldorf/Inn, Fed. Rep. of Germany

[21] Appl. No.: 150,200

[22] Filed: Jan. 29, 1988

[30] Foreign Application Priority Data

Feb. 16, 1987 [DE] Fed. Rep. of Germany ..... 3704873

[51] Int. Cl.[4] ..... H01R 13/187

[52] U.S. Cl. ..... 439/843; 439/851; 439/852

[58] Field of Search ..... 439/843, 846, 851, 852, 439/860, 821

[56] References Cited

U.S. PATENT DOCUMENTS 4,720,157 1/1988 Nestor et al. ..... 439/851

*Primary Examiner*—Gil Weidenfeld
*Assistant Examiner*—Steven C. Bishop
*Attorney, Agent, or Firm*—Holman & Stern

[57] ABSTRACT

An electrical contact device for transmitting high electric current includes a cylindrical contact pin (2) and a spring-loaded contact jack (1) for receiving the pin. A plurality of essentially axially parallel spring-loaded contact elements are provided which extend axially on the cylindrical inner wall of the jack. In order to allow contact over large tolerances between the contact pin (1) and contact spring jack (2), the jack is provided with intermediate spring contact elements (4,5) between it and an outer sleeve body (3) is which the jack is mounted with spring-loading both axially and radially.

9 Claims, 2 Drawing Sheets

FIG. 1
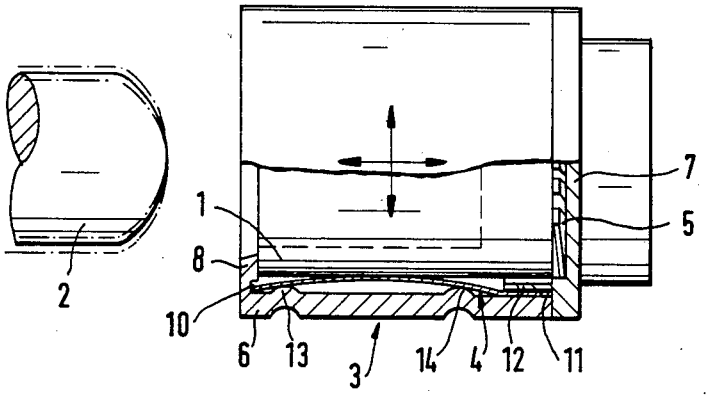
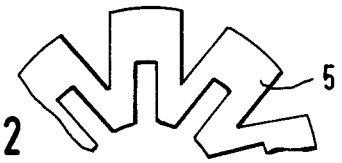
FIG. 2
FIG. 3
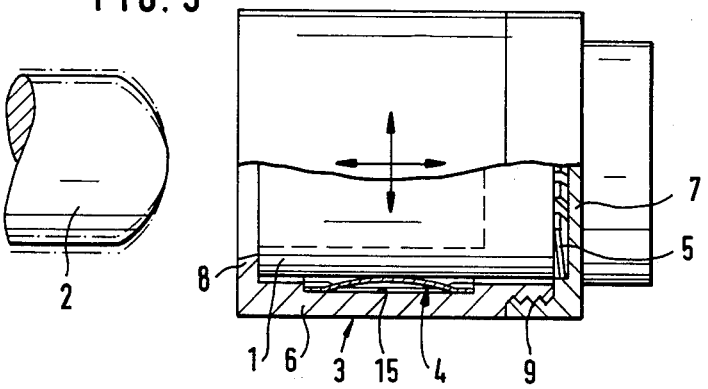

ELECTRICAL CONTACT DEVICE

BACKGROUND AND SUMMARY OF THE INVENTION

The invention relates to an electrical contact device for transmitting high electric current, comprised of a cylindrical contact pin or plug or the like, and a spring-loaded jack or socket for receiving the pin, with a plurality of essentially parallel spring-loaded contact elements extending axially on a cylindrical inner wall of the jack.

Such devices frequently present alignment problems, particularly when manipulated with the aid of robots, where the contact pin is not precisely aligned with the spring-loaded jack and consequently cannot be inserted into the jack. This problem also occurs when a plurality of jacks are combined into a single unit, for use with a unitized plurality of pins, where the axial (i.e. transverse) separations between the pins do not precisely match those of the jacks, but it is desired to insert the pins simultaneously into the respective jacks.

An underlying problem to which the invention is directed is to devise a contact device of the type described initially above, wherein the contact pins can be inserted into the spring-loaded contact jacks without problem even if during the insertion the respective pins and jacks are not precisely aligned.

This problem is solved, according to the invention, by a contact device which is distinquished essentially in that, in order to create a conduction path despite large tolerances between the contact pin and contact spring jack, the jack is provided with intermediate spring contact elements between it and an outer sleeve body in which the jack is mounted with spring-loading both axially and radially. It has been demonstrated that when a contact device with this construction is employed a pin can be withdrawn from the spring-loaded jack even when the lead to the pin is shifted to a substantial degree laterally with respect to the axis of the jack. The inner spring-loaded jack which is mounted in practically floating fashion within the outer sleeve body may be shifted into the lateral position necessary for receving the contact pin, without detriment to the current-carrying capability of the pin and jack combination. A lateral displacement of $+/-1$ mm is readily compensable. Further, the inventive contact device thus enables making a plug connection under electrical load.

The inventive contact device is given a particularly simple structure if the jack outer sleeve body is in the form of a cylinder with one closed end, with spring-loaded contact elements on its cylindrical wall and a spring-loaded contact disc on its base.

In this connection, it has proven particularly advantageous, with respect to both structure and operation, for the outer sleeve body to be comprised of two parts, in particular a cylindrical wall and a separate base which is fastenable to the wall; and for the forward edge of the cylindrical wall (the edge directed away from the base) to be provided with a radially inwardly extending flange for supporting the jack inner contact spring which is acted on by the spring action of the contact spring disc. It is easy to mount the contact spring elements on the cylindrical wall of the outer sleeve body prior to the introduction of the inner contact spring jack and after the fixed mounting of the contact spring disc, which latter mounting occurs by fastening the base to the cylindrical wall inside the outer sleeve body. The radially inwardly extending flange, against which the inner contact spring jack is braced, also serves to isolate the contact device under load, for spark protection purposes.

It has proven convenient to provide an assembly wherein the base of the sleeve body is fastened to the cylindrical wall by a screw thread.

Advantageously, the contact spring disc provided on the base may be in the form of a zig-zag configured star disc.

From a manufacturing standpoint it has proven advantageous to provide an axially elongated ring-shaped groove in the region of the radially inwardly extending flange, this groove serving to accomodate the forward ends of the wire spring segments, which segments are regularly distributed over the inner circumference of the cylindrical wall. Further, it is also advantageous to provide a ring-shaped gap between the cylindrical wall and an axially inwardly projecting member on the base, which base is fastened to the cylindrical wall of the outer sleeve body, this gap serving to accommodate the rear ends of the wire spring segments. Still further, it is advantageous to provide two radially impressed ring-shaped inwardly extending ridges in the sleeve body at an axial distance apart, whereby the wire spring segments rest against these ridges while under elastic bending.

Alternatively, it is also advantageous to provide the outer sleeve body with at least one shallow cylindrical recess in the region of the interior of the cylindrical wall, for accommodating the contact spring elements. In particular, a contact spring mat structure comprising the contact spring elements can thus be accommodated. According to an advantageous variant, each shallow cylindrical ring-shaped recess accommodates a ring-shaped contact strip comprised of a plurality of spring-loaded contact fingers which are bent around by approximately 180° and extend out of the plane of the cross-piece joining them.

BRIEF DESCRIPTION OF THE DRAWINGS

Additional details, advantages, and features of the invention will be apparent from the following description. Exemplary embodiments of the invention are illustrated in the drawings, in which:

FIG. 1. is a partial cross-sectional view of an electrical contact device according to the present invention;

FIG. 2 is a view of segment of the contact spring disc;

FIG. 3 is a partial cross-sectional view of a modified electrical contact device according to the present invention;

DETAILED DESCRIPTION OF THE INVENTION

Figure 4:
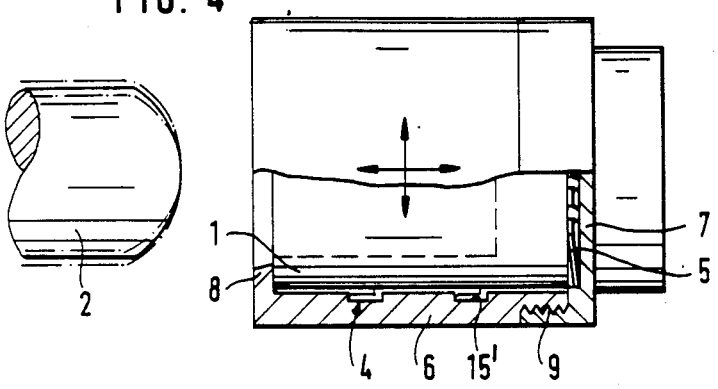
FIG. 4 is a partial cross-sectional side view of another variant embodiment of an electrial contact device according to the present invention.

As seen from the drawings, an ordinary spring-loaded jack 1, having a plurality of contact springs (not shown) mounted on its cylindrical inner wall and serving to receive a contact pin 2, is mounted in an outer sleeve body 3 having spring-loading both axially and radially as indicated by the arrows. This sleeve body 3 is in the form of a cylinder with one closed end. The interior of the sleeve body cylindrical wall has contact spring elements 4 mounted on it which provide spring action in the radial direction. The bottom end of body 3 is provided with a contact spring disc 5 to provide spring action in the axial direction.

The outer sleeve body 3 has a structure comprised of two parts, a cylindrical wall 6 and a base 7 which can be fastened to wall 6. On the forward edge of the wall 6 (the edge directed away from the base 7), a radially inwardly extending flange 8 is provided which serves to support the inner jack 1 which is being acted upon by the contact spring disc 5. The base 7 may be fastened to the cylindrical wall 6 by press fitting. More advantageously, however, it may be screwed on by threads 9 as shown in FIG. 3.

The contact spring disc 5 on the base is in the shape of a star disc with a generally zig-zag or convoluted configuration as shown in FIG. 2, and with a central region projecting (i.e., bulging) out of the plane of the edge region of the disc.

As seen from FIG. 1, an axial ring-shaped groove 10 is provided in the region of the radially inwardly extending flange 8, which groove 10 serves to receive the front ends of spring wire segments which form the contact spring elements 4 and are regularly distributed around the cylindrical wall 6. The rear ends of these wire segments extend into a ring-shaped gap 11 between the cylindrical wall 6 and an axial projection 12 on the base 7. Following the mounting of the wire segments in this manner, two radially impressed ring-shaped inwardly extending ridges 13, 14 are produced in the sleeve body 3 spaced at an axial distance apart. The spring wire segements which have been forced into an elastically curved state are supported against these interior ridges.

In the variant embodiments according to FIGS. 3 and 4, at least one shallow cylindrical recess 15 is provided in the interior side of the cylindrical wall 6, for accommodating the spring-loaded contact elements 4. The variant according to FIG. 3 includes a contact spring mat which forms the contact elements 4. In this spring mat, the ends of the spring wire segments are fixed to parallel crosspieces (or web pieces) disposed at an axial distance apart, with the fixing being by means of soldering or brazing, for example. The crosspieces are joined by separating strips which advantageously may be unitary with the crosspieces themselves. In a subsequent step, the separating strips are deformed, resulting in a reduction of the separation between the crosspieces and elastic curving (i.e., bending) of the spring wire segments. The manufacture of such a contact spring mat is the subject of a former patent application, German Pat. App. P No. 36 1.5 915.8.

Figure 5:
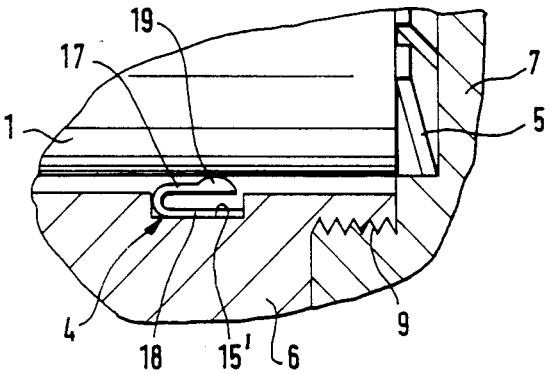
FIG. 5 is an enlarged detail view of FIG. 4.
Figure 6:
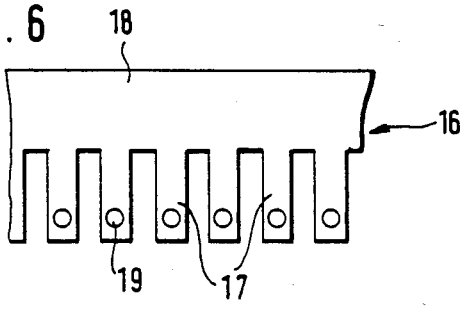
FIG. 6 is a segmentary view of contact elements which are provided in the form of a ring-shaped spring-loaded contact strip.

In the variant embodiment according to FIGS. 4 and 5, two ring-shaped recesses 15' are provided, each of which serves to accommodate a respective contact ring strip 16 which forms the contact spring elements 4. FIG. 6 illustrates the contact ring strip 16 which is stamped from a piece of contact spring sheet metal. The fingers 17 of comb-like contact spring configuration extend from a common web member 18 and are curvedly bent over backwards by approximately 180° from web member 18. The contact projections 19 at the ends of each finger 17 rest against the outer wall of the inner contact spring jack 1 in the assembled device.

This embodiment, as are the others, is also distinguished by allowing for introduction of the associated contact pin 2 into the contact spring jack assembly even if the pin 2 is at a laterally displaced position as indicated by the dashed lines.

What is claimed:

1. An electrical contact device for transmitting high electric current, comprised of a cylindrical contact pin and a spring-loaded contact jack for receiving the pin, wherein a plurality of essentially axially parallel spring-loaded contact elements extend axially on a cylindrical inner wall of the jack; characterized in that, in order to create a conduction path with high tolerances between the contact pin and contact spring jack, the jack is provided with intermediate spring contact elements with spring-loading both axially and radially between it and an outer sleeve body in which said jack is mounted.

2. An electrical contact device according to claim 1, characterized in that the outer sleeve body has the shape of a cylinder with one closed end, with spring-loaded contact elements on its cylindrical wall and a spring-loaded contact disc on its base.

3. An electrical device according to claim 1, characterized in that the outer sleeve body is comprised of two parts, and comprises a cylindrical wall and a separate base which is fastenable to the wall; and in that a forward edge of the cylindrical wall directed away from the base is provided with a radially inwardly extending flange for supporting an inner contact spring jack which is acted on by the spring action of a contact spring disc.

4. An electrical device according to claim 3, characterized in that the base of the sleeve body is fastened to the cylindrical wall by a screw thread.

5. An electrical contact device according to claim 2, characterized in that the contact spring disc provided on the base is in the form of a generally zig-zag configured star disc.

6. An electrical contact device according to claim 3, characterized in that:

an axially elongated ring-shaped groove is provided in the region of the radially inwardly extending flange, said groove serving to accommodate forward ends of wire spring segments, which segments are regularly distributed over the cylindrical wall;

and further in that a ring-shaped gap is provided between the cylindrical wall and an axially inwardly projecting member on the base, which base is fastened to the cylindrical wall of the outer sleeve body, said gap serving to accommodate rear ends of the wire spring segments;

and in that two radially impressed ring-shaped inwardly extending ridges are provided at an axial distance apart in the sleeve body, whereby the wire spring segments are supported against said ridges while under elastic curving.

7. An electrical contact device according to claim 2, characterized in that the outer sleeve body is provided with at least one shallow cylindrical recess in the region of the interior of the cylindrical wall thereof, for accommodating the contact spring elements.

8. An electrical contact device according to claim 7, characterized in that each said shallow cylindrical recess serves to accommodate a contact spring mat structure formed of the contact spring elements.

9. An electrical contact device according to claim 7, characterized in that each said shallow cylindrical recess is ring-shaped and accommodates a ring-shaped contact strip having a plurality of spring-loaded contact fingers which are bent around by approximately 180° and which extend out of the plane of a crosspiece which joins them.

* * * * *